US008235022B2

(12) United States Patent
Ni et al.

(10) Patent No.: US 8,235,022 B2
(45) **Date of Patent: *Aug. 7, 2012**

(54) OIL SUPPLY SYSTEM FOR INTERNAL COMBUSTION ENGINE

(75) Inventors: Ben Xuehai Ni, Canton, MI (US); Jagadish Sorab, West Bloomfield, MI (US)

(73) Assignee: Ford Global Technologies, Dearborn, MI (US)

( * ) Notice: Subject to any disclaimer, the term of this patent is extended or adjusted under 35 U.S.C. 154(b) by 356 days.

This patent is subject to a terminal disclaimer.

(21) Appl. No.: 12/364,035

(22) Filed: Feb. 2, 2009

(65) Prior Publication Data

US 2010/0192899 A1 Aug. 5, 2010

(51) Int. Cl.
*F01M 1/04* (2006.01)
*F01M 11/10* (2006.01)

(52) U.S. Cl. ..... 123/196 CP; 123/196 S; 123/196 R; 184/6.5

(58) Field of Classification Search ..... 123/196 CP, 123/196 S
See application file for complete search history.

(56) References Cited

U.S. PATENT DOCUMENTS

| | | | | |
|---|---|---|---|---|
| 3,119,229 | A * | 1/1964 | Gottlieb | 60/602 |
| 3,485,324 | A * | 12/1969 | Novak | 184/6 |
| 4,204,487 | A * | 5/1980 | Jones | 123/41.35 |
| 4,331,112 | A * | 5/1982 | Pluequet | 123/196 S |
| 4,452,188 | A * | 6/1984 | Kosuda et al. | 123/90.18 |
| 5,085,181 | A | 2/1992 | Feuling | |
| 5,249,556 | A | 10/1993 | Emmitt | |
| 5,509,381 | A | 4/1996 | Fisher | |
| 5,509,383 | A * | 4/1996 | Kahrs et al. | 123/90.12 |
| 6,523,519 | B2 * | 2/2003 | Iwano et al. | 123/196 R |
| 6,973,908 | B2 * | 12/2005 | Paro | 123/196 R |
| 7,036,480 | B2 * | 5/2006 | Williams et al. | 123/196 S |
| 2002/0083915 | A1 | 7/2002 | Choi | |
| 2005/0045142 | A1 | 3/2005 | Rozario et al. | |
| 2006/0070600 | A1 | 4/2006 | Hara | |

* cited by examiner

*Primary Examiner* — Noah Kamen
*Assistant Examiner* — Grant Moubry
(74) *Attorney, Agent, or Firm* — Jerome R. Drouillard; Julia Vouytras

(57) ABSTRACT

A lubricating oil supply system for internal combustion engine includes an oil reservoir and oil pump connected with a lubrication distribution network including a pressure controller which selectively controls the pressure within the distribution network to at least one pressure value that is less than the maximum pressure produced by a pressure relief valve associated with the oil pump.

9 Claims, 3 Drawing Sheets

OIL SUPPLY SYSTEM FOR INTERNAL COMBUSTION ENGINE

CROSS REFERENCE TO RELATED APPLICATIONS

None.

BACKGROUND OF THE INVENTION

1. Field of the Invention

The present invention relates to an internal combustion engine lubrication system in which pressure within the lubrication system is controlled by both mechanically and electrically operated valves.

2. Related Art

Pressure-lubrication has been used with automotive internal combustion engines for many years. Typically, a single pressure relief valve is used to limit the maximum pressure developed by an oil pump. The relief pressure is usually set at a fairly high value, in order to assure that the engine receives adequate lubrication in all operating regimes from idle to maximum speed-load operation. Unfortunately, this causes the lubrication pump's energy consumption to be higher than would otherwise be ideal, because in many operating regimes, only a reduced volume and pressure of oil is required by the engine.

US Patent Publication 2002/0083915 discloses a system in which a minimum oil pressure is established by a mechanically operated valve, with an electrically operated valve positioned in the mechanical valve's relief port such that the system pressure may be increased through closure of the electronically operated valve. This system suffers from the drawback that the electrically operated valve does not have a fail-safe position. In the event that the electrically operated valve fails in an open position, only minimal oil pressure would be available to sustain the engine, and such minimal oil pressure would undoubtedly be inadequate to support the engine during high speed and load operation. On the other hand, if the electrically operated valve fails in a closed position, the resulting excessive oil pressure may damage or destroy the engine by causing the oil filter to rupture, with a consequent loss of all oil overboard. In other words, any failure of the electronic valve could lead to engine failure. In another vein, the reliability of the electrically operated valve is compromised because only unfiltered oil flowing from the oil pump passes through the valve, and foreign matter carried by the unfiltered oil may cause the valve to stick or wear excessively.

It would be desirable to provide an internal combustion engine lubrication system in which an engine is reliably protected with a high pressure mechanical relief valve, combined with the capability of reducing the oil pressure so as to promote fuel economy improvement during operating regimes in which maximum oil pressure and flow are unneeded.

SUMMARY OF THE INVENTION

According to an aspect of the present invention, a lubricating oil supply system for an internal combustion engine includes an oil reservoir and an oil pump for pressurizing oil from the reservoir. A lubrication distribution network is connected with the oil pump. A pressure relief valve is connected to the distribution network downstream from the oil pump. The pressure relief valve limits oil pressure within the distribution system to a maximum permissible value. A pressure controller operatively connected with the distribution network downstream from the pressure relief valve, and preferably downstream from an oil filter, selectively controls the pressure within the distribution network to at least one pressure value which is less than the maximum pressure produced by the pressure relief valve.

According to another aspect of the present invention, a pressure controller suitable for use as part of the current oil supply system may include a normally closed control valve placed in series with a low pressure relief valve, with the control valve being operated by an engine controller. Alternatively, the pressure controller may include a normally closed proportional control valve operated by an engine controller. In any event, the pressure relief bypass valve limits the oil pressure within the distribution network to a maximum permissible value by transferring high pressure oil from the outlet of the pump to the oil pump's inlet, whereas the pressure controller, which is operatively connected with the distribution network downstream from the pressure relief valve, controls the pressure within the distribution network by returning oil from the distribution network to the oil reservoir, with the pressure controller selectively limiting the pressure within the distribution network to a pressure value which is less than the maximum pressure produced by the pressure relief valve.

It is an advantage of a lubricating oil supply system according to the present invention that engine fuel consumption may be reduced by minimizing parasitic losses associated with the oil pump, while at the same time safeguarding the engine's integrity, by using a pressure controller with a normally closed valve, such that if the valve fails, the engine oil pressure will be maintained at a safe level for all engine operating modes and regimes.

It is another advantage of a system according to the present invention that the pressure controller of the present invention may be mounted externally upon the engine, as opposed to the known conventional practice of mounting of relief valves deep inside an engine, such as in an engine oil pump, rendering such valves relatively inaccessible for service purposes.

It is an advantage of a system according to the present invention that the pressure controller of the present invention may be located downstream from an oil filter, thereby protecting the pressure controller from oil-borne contamination.

Other advantages, as well as features of the present invention, will become apparent to the reader of this specification.

DETAILED DESCRIPTION OF THE PREFERRED EMBODIMENTS

Figure 1:
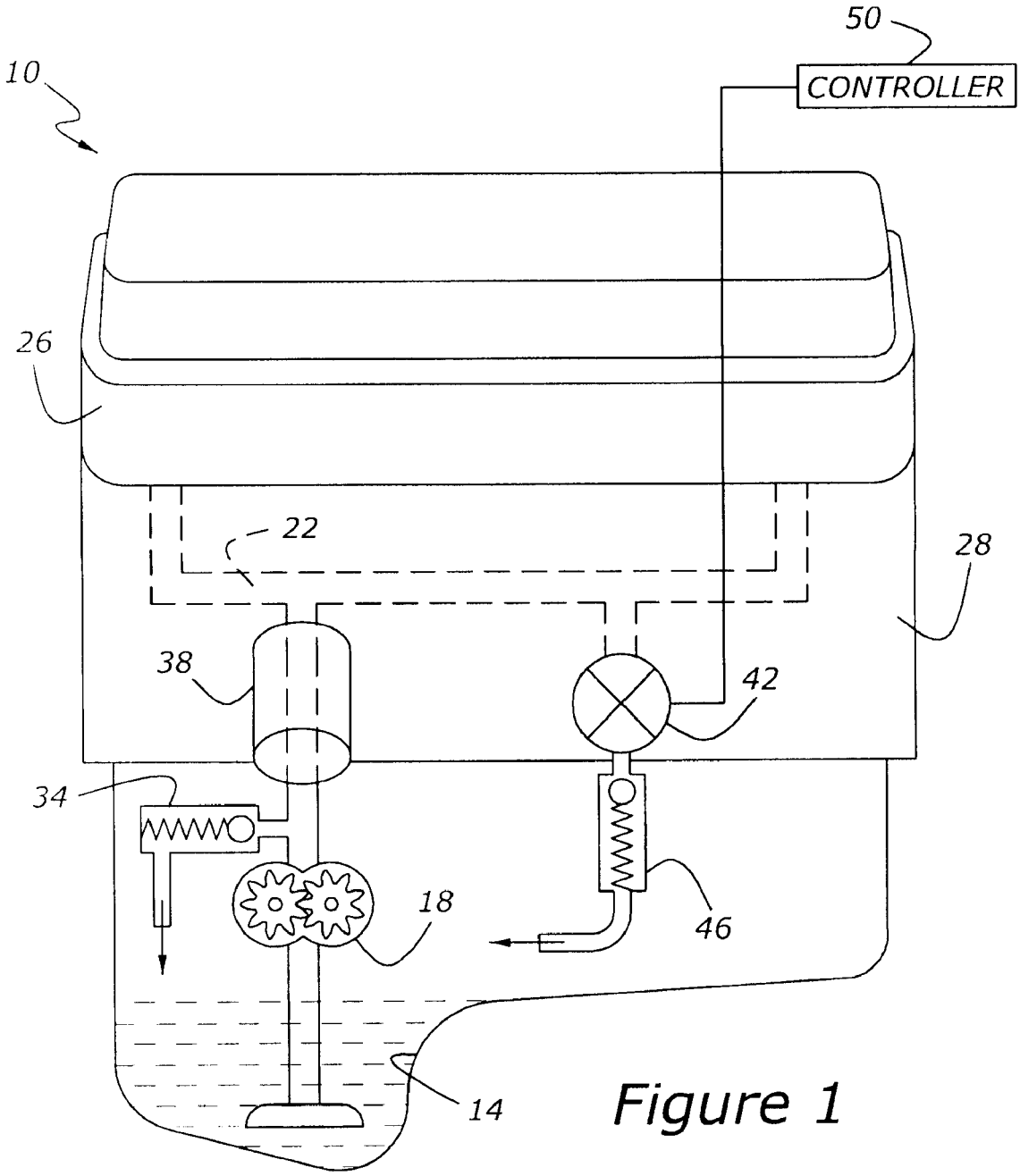
FIG. 1 is a schematic representation of an internal combustion engine having a lubricating oil supply system according to the present invention.

As shown in FIG. 1, an engine, 10, has an oil reservoir, 14, extending below a cylinder block, 28, and a cylinder head, 26. A lubrication distribution network, 22, is connected with an oil pump 18. Those skilled in the art will appreciate in view of this disclosure that oil pump 18 could comprise either a gerotor type pump either driven concentrically by an engine crankshaft, or a gear pump or gerotor pump, typically mounted to the engine's cylinder block and driven by either a camshaft or another rotating component of the engine, or yet other types of pump arrangements. Such detail is committed to those wishing to employ the inventive oil supply system described and claimed herein.

The present lubricating oil supply system includes not only oil reservoir 14, oil pump 18, and lubrication distribution network 22, but also a high pressure relief valve, 34, employed to limit the oil pressure within distribution network 22 to a maximum permissible value. In other words, pressure relief valve 34 clips the oil pressure to a predetermined maximum value. This protects, for example, oil filter 38 from destruction were the oil pressure to be too high during cold operation at higher engine speeds.

Figure 2:
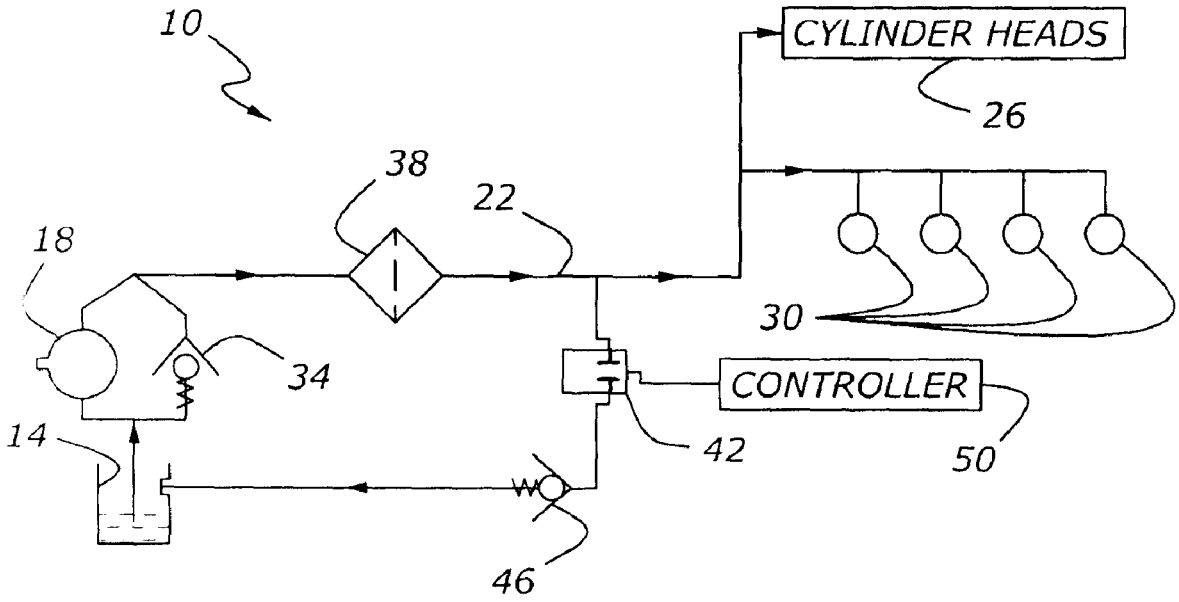
FIG. 2 is a schematic representation of an engine lubrication supply system according to an aspect of the present invention, operating at a high pressure condition.
Figure 3:
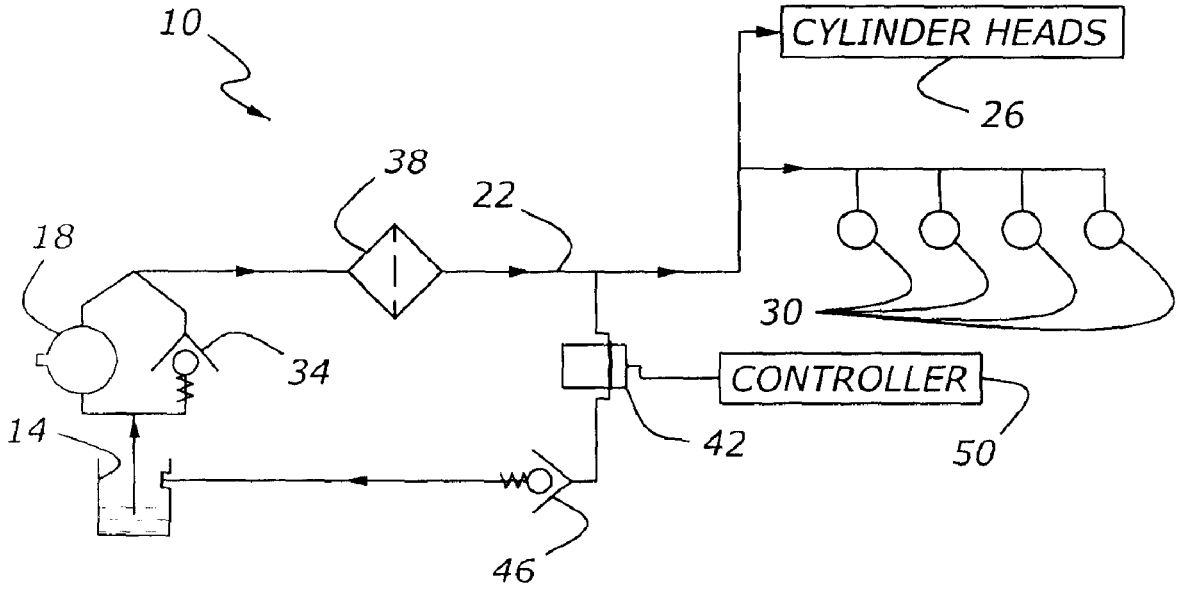
FIG. 3 is similar to FIG. 2 but shows a system of FIGS. 1 and 2 operating in a low pressure condition, as opposed to the higher pressure operation shown in FIG. 2.

The present system also includes a control valve, 42, which is part of a pressure controller. Control valve 42 and a low pressure relief valve, 46, are operatively connected with distribution network 22 downstream from high pressure relief valve 34 and preferably downstream from oil filter 38. As shown in FIGS. 1, 2, and 3, control valve 42 is placed in series with low pressure relief valve 46. When controller 50 provides an appropriate signal, control valve 42 opens, and the oil pressure within lubrication distribution network 22 is controlled by low pressure relief valve 46 to a lower maximum pressure which is less than the pressure allowed by valve 34. This is shown in FIG. 3. In this manner, oil pump 18 is required to do less work because oil is pumped against a lower head. Because control valve 42 is normally closed, a loss of signal from controller 50 will merely cause the lubrication system to revert to a maximum pressure system controlled solely by pressure relief valve 34. This protects the integrity of engine 10. This state is shown in FIG. 2.

Although oil is bypassed at a lower pressure by valves 42 and 46, adequate oil pressure is provided to cylinder head 26 and to crankshaft bearings 30 because valve 42 is opened by controller 50 only during the several operating regimes in which it is not necessary to provide maximum oil pressure to sustain appropriate engine life. In fact, in many operating regimes such as those characterized by operation at less than half of the engine's maximum load, oil pressure may be significantly reduced while still providing adequate lubrication to the engine.

Figure 4:
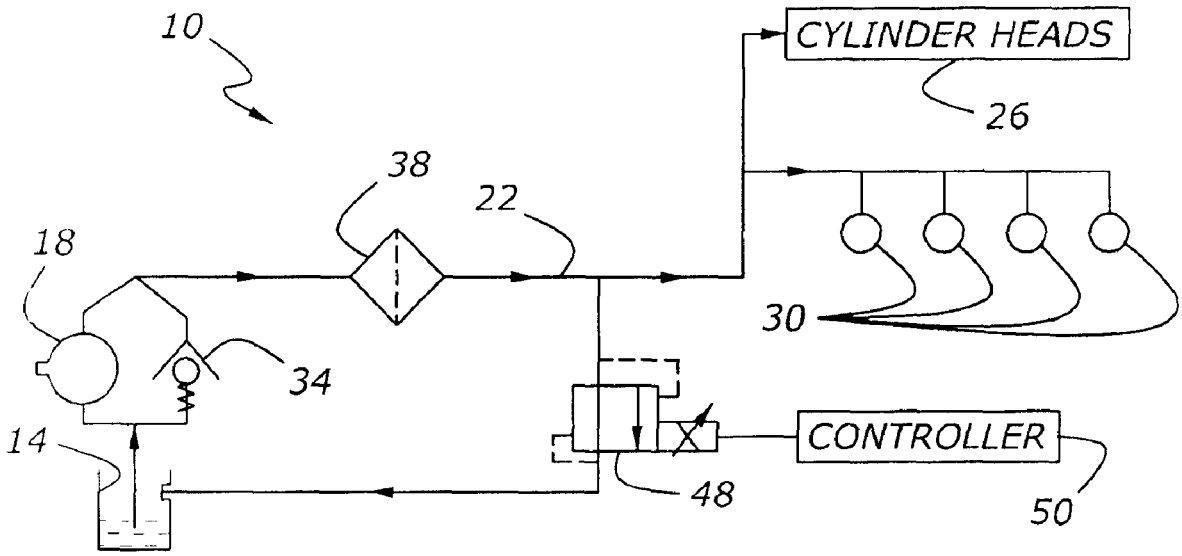
FIG. 4 shows an embodiment of the present system having a proportional pressure control relief valve.

FIG. 4 shows an embodiment of the present invention in which a proportional control valve, 48, is operated by controller 50. As its name implies, valve 48, working with controller 50, provides a tailored, but reduced, oil pressure which is intended to increase engine fuel economy by providing no more pressure than is needed to sustain the life of the engine's bearings and other lubrication using devices. As with the other embodiments of this invention, proportional control valve 48 is a normally closed device, such that if the power fails between controller 50 and valve 48 or the signal is lost, valve 48 will close, thereby allowing the engine to be operated with only relief valve 34 being active, with valve 34 holding the engine oil pressure at a higher safe value. In general, according to a preferred embodiment, controller 50 will operate valve 48 as a function of at least engine operating speed, or at least engine operating speed, oil temperature and engine load.

Valves 42, 46, and 48, as the case may be, are preferably mounted to an external surface of engine 10, such as an outer surface of cylinder block 28. Such external mounting is shown in FIG. 1. This will permit relatively easy access to valves 42 and 46, or 48 for the purposes of repair or adjustment, without the necessity of removing engine hardware such as the oil pan or front cover.

The foregoing invention has been described in accordance with the relevant legal standards, thus the description is exemplary rather than limiting in nature. Variations and modifications to the disclosed embodiment may become apparent to those skilled in the art and fall within the scope of the invention. Accordingly the scope of legal protection afforded this invention can only be determined by studying the following claims.

What is claimed is:

1. An internal combustion engine with a lubricating oil supply system, comprising:

an oil reservoir;

an off pump driven by said engine, with said oil pump having an inlet and an outlet, with the oil pump picking up oil from said reservoir and pressurizing said oil;

a lubrication distribution network connected with said pump;

a pressure relief bypass valve, connected downstream from said oil pump, for limiting the oil pressure within said distribution network to a maximum permissible value by transferring high pressure oil from the outlet of the oil pump to the oil pump's inlet; and a pressure controller, operatively connected with said distribution network downstream from said pressure relief valve, for controlling the pressure within said distribution network by returning oil from the distribution network to the oil reservoir, with said pressure controller selectively limiting the pressure within the distribution network to a pressure value which is less than the maximum pressure regulated by the pressure relief valve, with said pressure controller comprising at least one control valve operated by an engine controller, wherein said control valve comprises a proportional control valve.

2. An engine according to claim 1, wherein said lubrication distribution network comprises a plurality of passages extending through the cylinder block to crankshaft bearings, an oil filter, and a cylinder head.

3. An engine according to claim 1, wherein said proportional control valve is normally closed.

4. An engine according to claim 1, wherein said control valve is located externally of said cylinder block.

5. An engine according to claim 1, wherein said control valve comprises an electrically operated valve in series with a mechanical relief valve.

6. An engine according to claim 1, wherein said engine controller operates said pressure controller to selectively limit the pressure within the distribution network to a pressure value which is less than the maximum pressure regulated by the pressure relief valve, at least when the engine is operated at less than about one-half of the engine's maximum load.

7. An engine according to claim 1, wherein said engine controller operates said pressure controller as a function of at least the operating speed of the engine.

8. An engine according to claim 1, wherein said engine controller operates said pressure controller as a function of at least the engine's operating speed and oil temperature.

9. An engine according to claim 1, wherein said engine controller operates said pressure controller as a function of at least the operating load imposed upon the engine.

* * * * *